US007285920B2

(12) United States Patent
Riederer et al.

(10) Patent No.: US 7,285,920 B2
(45) Date of Patent: Oct. 23, 2007

(54) METHOD AND CIRCUIT ARRANGEMENT FOR OPERATING A HIGH-PRESSURE GAS DISCHARGE LAMP

(75) Inventors: Xaver Riederer, Aachen (DE); Carsten Deppe, Aachen (DE); Holger Mönch, Vaals (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/513,484

(22) PCT Filed: May 5, 2003

(86) PCT No.: PCT/IB03/01744

§ 371 (c)(1),
(2), (4) Date: Nov. 3, 2004

(87) PCT Pub. No.: WO03/096760

PCT Pub. Date: Nov. 20, 2003

(65) Prior Publication Data

US 2005/0151482 A1 Jul. 14, 2005

(30) Foreign Application Priority Data

May 8, 2002 (DE) ..... 102 20 509

(51) Int. Cl.
*H05B 41/16* (2006.01)
*H05B 37/02* (2006.01)

(52) U.S. Cl. ..... 315/246; 315/307

(58) Field of Classification Search ..... 315/246, 315/291, 307, 209 R, 362
See application file for complete search history.

(56) References Cited

U.S. PATENT DOCUMENTS 5,608,294 A 3/1997 Derra et al. ..... 315/224
6,278,244 B1 * 8/2001 Hevinga et al. ..... 315/291

FOREIGN PATENT DOCUMENTS

JP 6290892 A 10/1994
JP 845678 A 2/1996

* cited by examiner

*Primary Examiner*—Thuy Vinh Tran

(57) ABSTRACT

A method and a circuit arrangement for the operation of a high-pressure gas discharge lamp (HID [high intensity discharge] lamp or UHP [ultra high performance] lamp) is described, which lamp is particularly suitable for illuminating projection displays with sequential color rendering (for example LCOS or SCR-DMD systems) with a pulsatory lamp current. Artefacts in the color rendering are avoided through the generation of at least one compensation pulse of a given amplitude and a given timing and through superimposition thereof on the lamp current.

6 Claims, 6 Drawing Sheets

METHOD AND CIRCUIT ARRANGEMENT FOR OPERATING A HIGH-PRESSURE GAS DISCHARGE LAMP

The invention relates to a method and to a circuit arrangement for operating a high-pressure gas discharge lamp (HID [high intensity discharge] lamp or UHP [ultra high performance] lamp) such that the latter is designed in particular for illuminating projection displays such as, for example, LCOS (liquid crystal on semiconductor) or SCR-DMD (sequential color recapture-digital micro mirror) color displays. The invention also relates to a projection system with a projection display, a high-pressure gas discharge lamp, and such a circuit arrangement.

A method and a circuit arrangement for operating a high-pressure gas discharge lamp is disclosed in U.S. Pat. No. 5,608,294. According to this publication, the lamp is operated with an alternating current, by means of which a fast erosion of the electrodes can be prevented and the efficacy of the lamp can be enhanced. Such an alternating current, however, also increases the risk of unstable arc discharges, which may lead to a flickering of the generated luminous flux. This finds its origin essentially in the fact that the arc discharge is dependent on the temperature and the condition of the surface of the electrodes and that in addition the time gradients of the electrode temperature are different for the phases in which the electrode acts as an anode and as a cathode. This again has the result that the electrode temperature changes considerably during one cycle of the lamp current. To eliminate this problem to a substantial degree, a current pulse is generated at the end of each half cycle of the lamp current, i.e. before a polarity change, which pulse has the same polarity and is superimposed on the lamp current, so that the total current is increased and the electrode temperature rises. The stability of the arc discharge can be considerably improved thereby.

This current change, however, also has the result that the lamp is now operated with an alternating lamp current which comprises more or less strongly accentuated pulsatory components, which in their turn cause a correspondingly pulsatorily increased luminous flux. This, however, may lead to artefacts in particular if such a lamp is used for illuminating a projection display with sequential color rendering.

This relates, for example, to LCOS displays, in which the three primary colors run sequentially over the display in the form of color bars (cf. Shimizu: "Scrolling Color LCOS for HDTV Rear Projection" in SID 01 Digest of Technical Papers, vol. XXXII, pp. 1072 to 1075, 2001). Whenever the luminous flux rises owing to a current pulse, the brightness of the color bars rises correspondingly. As a result, the colors are always represented with a higher brightness in certain regions of the display than in other regions of the display, in dependence on the instantaneous positions of the color bars. To achieve a good picture quality, however, the brightness of the three colors should be equal in all picture regions, in particular if the alternating lamp current is synchronized with the image repetition frequency for avoiding interference or similar effects.

The SCR-DMD projection displays are also affected by the above artefacts (cf. Dewald, Penn, Davis: "Sequential Color Recapture and Dynamic Filtering: A Method of Scrolling Color" in SID 01 Digest of Technical Papers, vol. XXXII, pp. 1076 to 1079, 2001).

It is accordingly an object of the invention to provide a method and a circuit arrangement for the operation of a high-pressure gas discharge lamp with which a particularly homogeneous luminous flux can be generated, also when the luminous flux is averaged over a comparatively short period of time.

In particular, a method and a circuit arrangement for operating a high-pressure gas discharge lamp with a pulsatory lamp current is to be provided by means of which in particular projection displays can be illuminated such that a substantially natural color impression is created.

Furthermore, a method and a circuit arrangement for operating a high-pressure gas discharge lamp with a pulsatory lamp current is to be provided by means of which in particular projection displays can be illuminated without substantial visible artefacts or other visually observable interferences.

Finally, a method and a circuit arrangement are to be provided by means of which a high-pressure gas discharge lamp can be operated such that thereby not only an artefact-free color rendering is achieved with a projection display having sequential color rendering, but also a flicker-free luminous flux with a stable arc discharge can be generated.

The object is achieved according to claim 1 by means of a method of operating a high-pressure gas discharge lamp wherein the lamp is fed with a lamp current on which are superimposed at least first current pulses and at least one second current pulse associated with each first current pulse, wherein said first and second current pulses have amplitudes in mutually opposed directions and a definable time difference between them, and wherein the number and/or the level of the amplitude and/or the time length of the second current pulses is/are adjusted such that the changes in the luminous flux caused by the first current pulse and by the at least one respective associated second current pulse compensate each other at least substantially.

The object is further achieved by means of a circuit arrangement as claimed in claim 6.

The fact that a luminous flux raised by, for example, a first current pulse is compensated by one or several second current pulses, which lead to a corresponding reduction in the luminous flux because of their opposed directions and their superimposition on the lamp current, renders it possible to generate a very homogeneous luminous flux, averaged over a (short) period of time, in particular if the time distance between the first and second current pulses is comparatively small.

A compensation is to be regarded as being achieved when—depending on the application of the lamp—the artefacts or other interferences mentioned above are no longer perceivable.

The dependent claims relate to advantageous further embodiments of the invention.

The distance in time between the first and the second current pulses is preferably chosen in accordance with claims 2 and 7 in the case of a lamp application for illuminating a projection display with sequential color rendering. A particular advantage of these solutions is that artefacts can be reliably avoided in a comparatively simple manner thereby and for substantially any cycle durations of the primary colors (subframe frequencies) of a projection display, without appreciable limitations having to be accepted as regards a current waveform optimized for the lamp operation in question.

The embodiments of claims 3 and 4 essentially have the advantage that a high-pressure gas discharge lamp is operated thereby on the one hand with a lamp current which is optimized, for example, as regards a homogeneous electrode erosion (alternating lamp current) and a flicker-free operation (additional current pulses), as described, for example, in U.S. Pat. No. 5,608,294, but which on the other hand can also be used in the lamp application for illuminating displays with sequential color rendering without artefacts being caused by the different pulse components.

Claim 5 renders possible a particularly simple embodiment of the method.

The circuit arrangement of claim 8 renders it possible to implement the method according to the invention in a comparatively simple and inexpensive manner.

Further details, features, and advantages of the invention will become apparent from the ensuing description of preferred embodiments, which is given with reference to the drawing, in which.

To clarify the general problem, the following observations are to be made first.

When a color display of the kind mentioned above is illuminated with a lamp whose supply current is superimposed with current pulses which lead to a corresponding pulsatory increase in the generated luminous flux (denoted first current pulses hereinafter), an uneven intensity distribution of the individual colors over the display may arise.

This is true in particular in the case of an alternating lamp current if this current is synchronized with the repetition rate of the primary colors (color bars), i.e. the subframe frequency, so as to avoid fluctuations in the picture, because this synchronity is then also given for the first pulses acting on the lamp current.

A luminous flux intensified in a pulsatory manner thus always hits the display when the three color bars have the same respective positions on the display, i.e., for example, when the blue color bar lies in the upper third, the green color bar in the central third, and the red color bar in the lower third of the display. This means that the blue colors will always have a higher brightness in the upper third, the green colors in the central third, and the red colors in the lower third of the display than they have in the respective other regions of the display.

Artefacts arising in this manner or other visually perceivable interferences are to be prevented by the invention, and an at least substantially natural color rendering is to be achieved.

A basic idea of the invention is that the color brightness of one color bar increased by a first current pulse of the kind mentioned above is compensated in the relevant regions of the display in that this brightness is correspondingly reduced when the color bars have reached the same display regions again in one (or several) subsequent subframe cycle or cycles. This is achieved in that a current pulse is superimposed on the lamp current at the relevant moment or moments, which pulse (denoted the second current pulse hereinafter) reduces the lamp current and thus also the generated luminous flux correspondingly.

Owing to the high subframe frequency, which is at least three times the repetition frequency of the image (video frequency), the alternating different brightnesses of one color in one and the same region of the display are not perceivable to the human eye, but are averaged to the brightness level obtaining in those phases of the lamp current in which said pulses do not occur, i.e. to the brightness level of the respective same color in other regions of the display.

Figure 1:
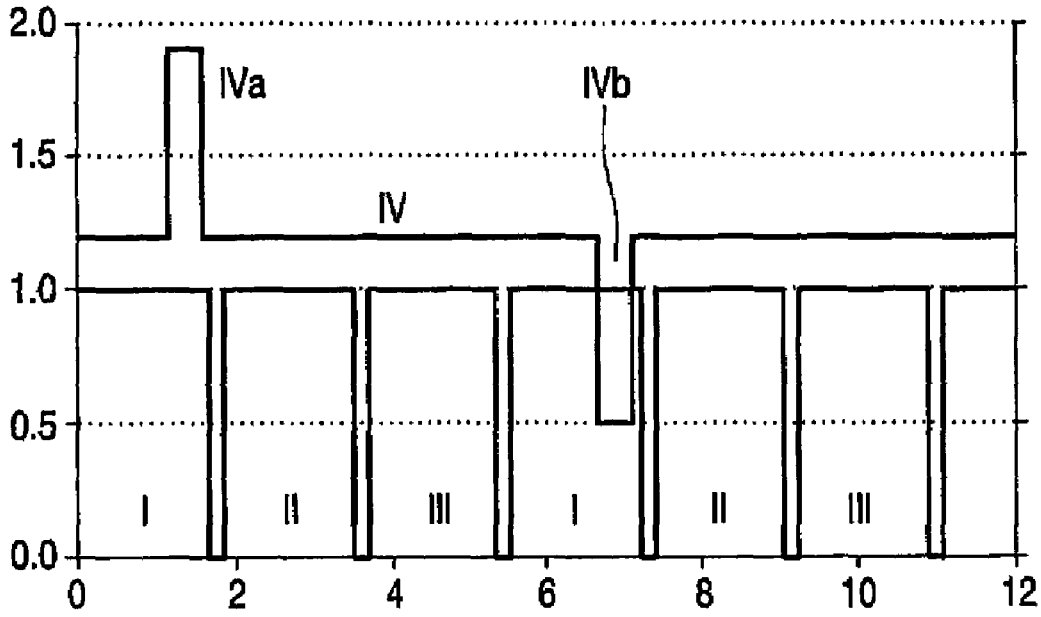
FIG. 1 shows the time gradient of the color activation and of a luminous flux in a line of a display.

FIG. 1 shows the simplest case of this compensation for one line of a display. The transmissivity of the individual color segments red (I), green (II), and blue (III) is plotted on the vertical axis, which segments transmit red, green, and blue light, respectively, one after the other in time. Furthermore, this Figure shows the time gradient of the luminous flux (IV, absolute luminous flux) with superimposed pulses. A first pulse (IVa) increasing the luminous flux has the result that the red color segment activated at this very moment lights up particularly strongly. This increased color brightness is compensated by a second pulse (IVb) which leads to a correspondingly lower luminous flux of the lamp and which is generated in the next phase in which the red color segment is activated. Averaged over time, accordingly, a homogeneous illumination of the display with the various colors is achieved without artefacts or other visually perceived interferences occurring.

In dimensioning a circuit arrangement for generating a suitable lamp current and for operating a discharge lamp, it is necessary to take into account the following requirements and parameters for optimizing the picture quality: the length in time of the second (current) pulses generated for compensation should be equal to the length of the first (current) pulses. The frequency, and thus the time shift of the second pulses, should be activated with the same colors in the same locations of the display each time, in accordance with the subframe frequency or the subframe cycle (or a multiple thereof).

It should also be observed that a second current pulse, i.e. the amplitude thereof, cannot exceed the level of the lamp current during the pulse-free phases. If the lamp current during the first current pulse is higher than twice the lamp current in the pulse-free phases under certain operational conditions, it is necessary to generate several second current pulses each with a sufficient amplitude and with the distance in time mentioned above (assuming that the lamp current cannot be limited accordingly during the first pulse).

It is furthermore required in the case in which the lamp is operated with a lamp current of alternating polarity, for avoiding a fast and irregular erosion of the electrodes, or for other reasons, that the arrangement in time of the current pulses takes place such that a first current pulse is generated each time before a change in polarity of the lamp current, which pulse has the same polarity as the instantaneous lamp current and thus increases the latter. Instabilities in the arc discharge and an accompanying flickering can be avoided thereby.

It should also be observed that no low-frequency components become visible on the display, superimposed on the pulse frequencies and leading to interferences. Finally, the limit frequency of the lamp and of the entire projection system including the display should also be taken into account in determining the level of the pulse frequencies.

Figure 2:
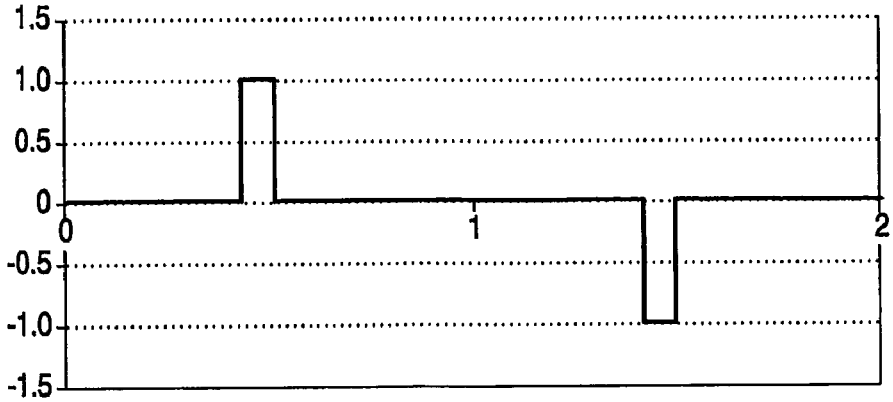
FIG. 2 shows a first basic function for compensating an increased luminous flux.
Figure 3:
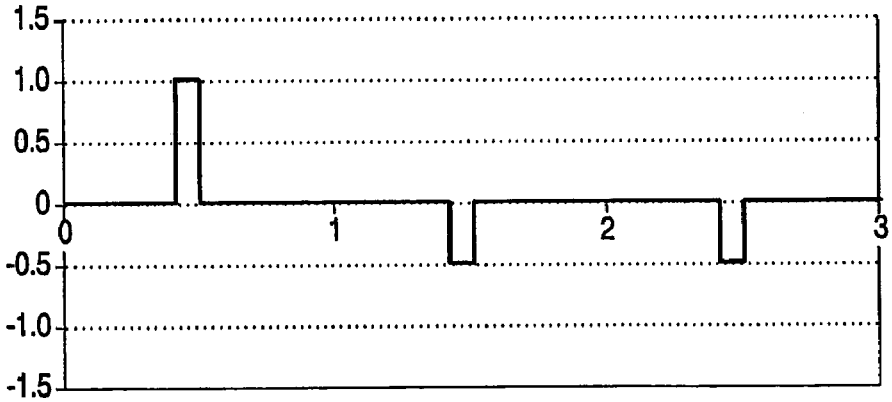
FIG. 3 shows a second basic function for compensating an increased luminous flux.
Figure 4:
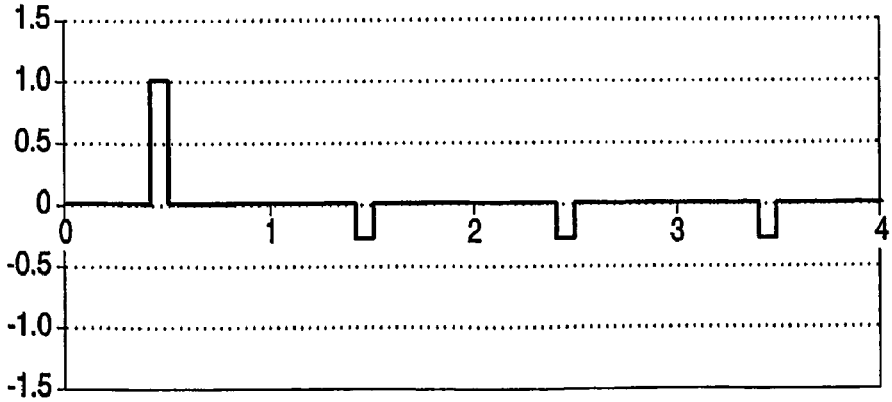
FIG. 4 shows a third basic function for compensating an increased luminous flux.

FIGS. 2 to 4 show three different possibilities of the compensation (basic functions) of a luminous flux increased by a first pulse. In contrast to the representation in FIG. 1, the vertical axis now shows only the change in luminous flux (relative luminous flux) caused by the pulses (i.e. the difference between the brightnesses generated by the pulses and by the non-pulsed lamp current). The horizontal axis is standardized each time to the number of full passages through all color bars on the display, i.e. the subframe frequency. The basic functions shown in FIGS. 2 to 4 may also be combined with one another.

In detail, a first pulse is compensated in FIG. 2 by a second pulse of the same amplitude and length in the next subframe in the same location. As is shown in FIG. 3, a first pulse is compensated by two second pulses of the same length and half the amplitude in the two subsequent subframes. In FIG. 4, finally, a first pulse is compensated by three second pulses of the same length and one third of the amplitude of the first pulse in the three subsequent subframes. The amplitudes of the second pulses always have a direction opposed to that of the amplitude of the first pulse.

It is also possible to use more than three second pulses for compensation. This, however, also increases the proportion of low-frequency components in the light radiation, so that the risk of visible artefacts arising is also increased thereby.

Furthermore, the individual pulses may be generated substantially at any desired locations within a subframe. The determining factor is exclusively the distance in time of the pulses with respect to one another, which should correspond as exactly as possible to the time duration of one subframe (or a multiple thereof). It is thus also conceivable to carry out a compensation through generation of a second pulse in the next subframe but one.

Figure 5:
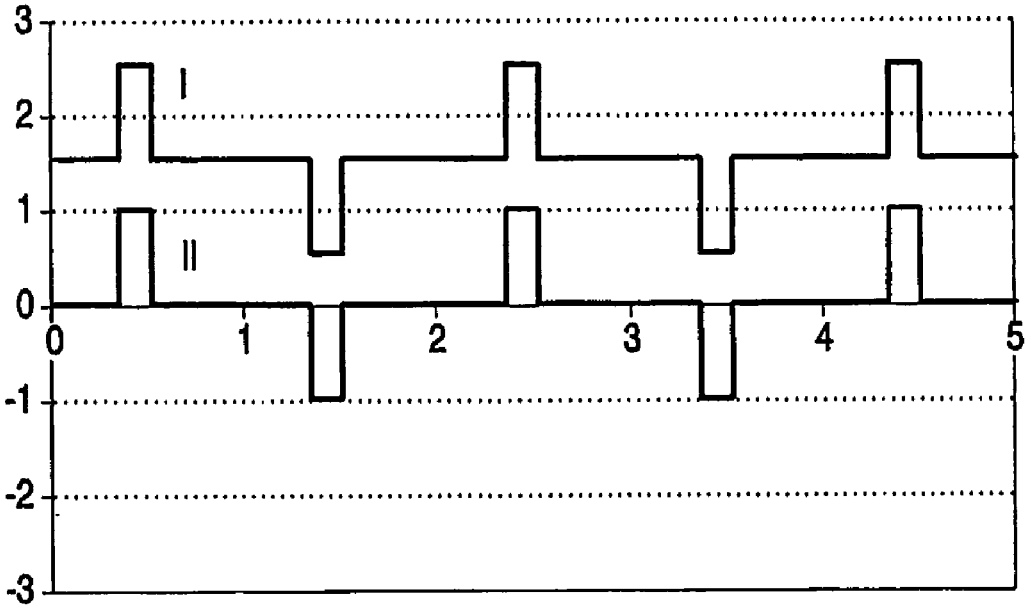
FIG. 5 is a time diagram of an absolute and a relative luminous flux in accordance with the first basic function.
Figure 6:
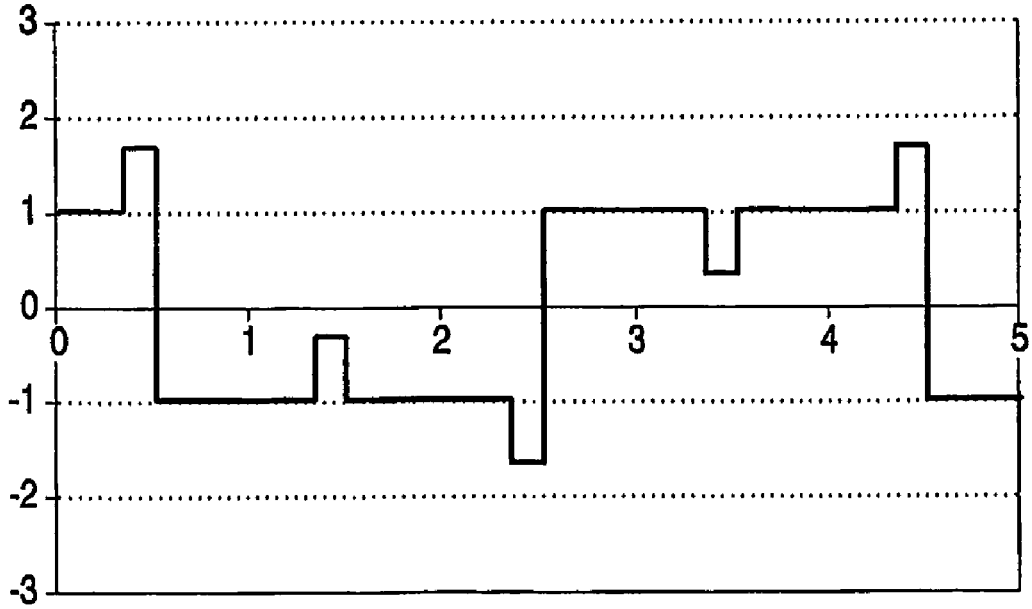
FIG. 6 shows a time gradient of an alternating lamp current with compensation pulses for the case shown in FIG. 5.

FIG. 5 once more shows the time gradients of the absolute (I) and the relative (II) luminous flux for the first basic function shown in FIGS. 1 and 2, and FIG. 6 shows the gradient in time of a corresponding alternating lamp current for realizing this compensation. Given a certain subframe frequency, the cycle duration of the alternating lamp current and its phase angle is preferably laid down and synchronized for safeguarding the stability of the arc discharge such that a first pulse is always generated with the same polarity as the instantaneous lamp current before a change in polarity takes place.

If the frequency of the alternating lamp current is to be increased relative to the subframe frequency, additional first pulses are to be inserted, by means of which the stability of the arc discharge is safeguarded, as was mentioned above.

It should be observed during this, however, that the lamp current resulting therefrom may comprise DC components under certain circumstances. For example, if two pulse sequences of FIG. 2 are combined, two first pulses and two second pulses will always follow one another. Since it is advantageous for lamp operation to invert the current direction after each first pulse, this would lead to a DC component in the lamp current. The combination of three pulse sequences of FIG. 2, or the combination of two pulse sequences of FIG. 3 makes it possible to avoid a DC component.

Figure 7:
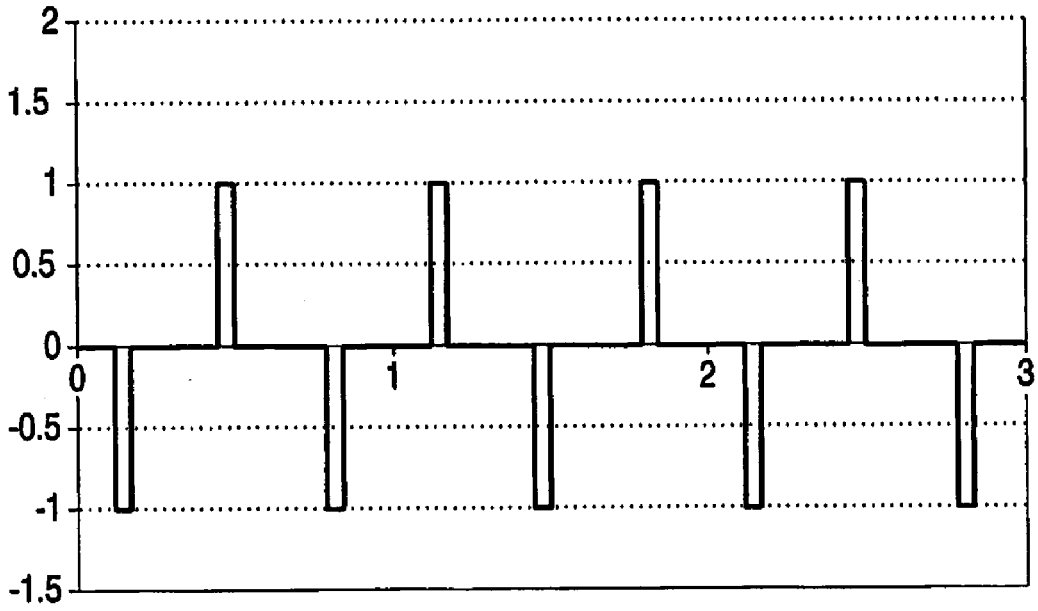
FIG. 7 shows a time gradient of a relative luminous flux with a combination of three of the first basic functions.
Figure 8:
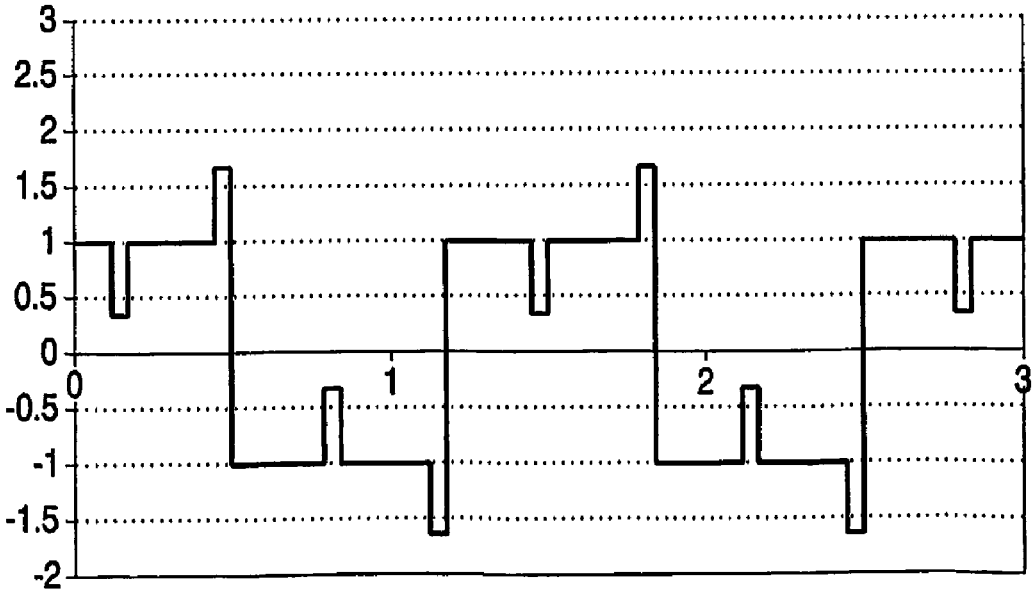
FIG. 8 shows a time gradient of an alternating lamp current with compensation pulses for the case shown in FIG. 7.

FIG. 7 shows the relative luminous flux in a combination of three basic functions of the kind shown in FIG. 2, involving a phase shift of approximately ⅔ subframe each, such that within one subframe a first and two second, and in the next subframe two first and one second pulse are present. FIG. 8 shows the corresponding gradient of the alternating lamp current. Given a subframe frequency of 180 Hz, a lamp frequency of 135 Hz is obtained.

As was noted above, it may occur that a first pulse cannot be compensated by only one second pulse. In this case, at least one of the (second and third) basic functions as shown in FIG. 3 or 4 is to be used.

If only one such basic function is used, however, a comparatively low lamp frequency will be the result. For example, only one first pulse arises within three subframes in the compensation shown in FIG. 3, so that a subframe frequency of 180 Hz will lead to a lamp frequency of only 30 Hz. A linear combination of the basic functions is to be preferred for this reason.

Figure 9:
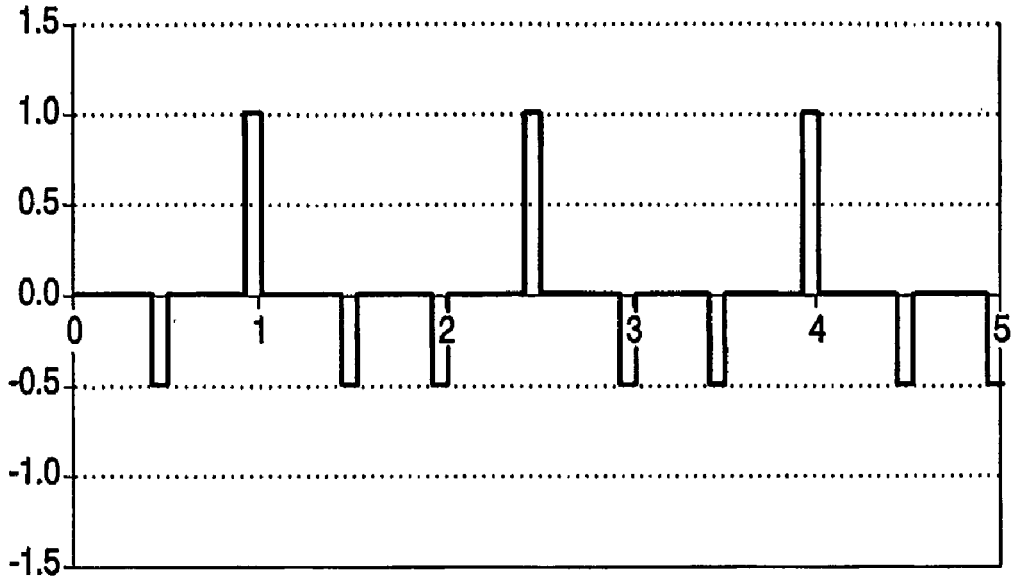
FIG. 9 shows a time gradient of a relative luminous flux with a combination of two of the second basic functions.

FIG. 9 shows the relative luminous flux in a combination of two (second) basic functions of the kind shown in FIG. 3, which have a phase shift of 1.5 subframe with respect to one another. A time gradient of the lamp current as shown in FIG. 10 is the result of this.

Figure 10:
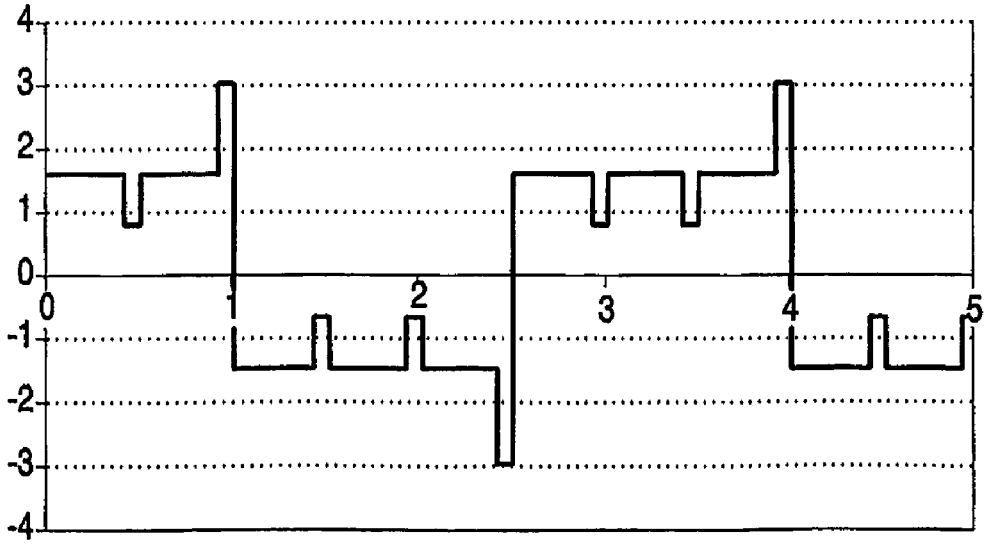
FIG. 10 shows a time gradient of an alternating lamp current with compensation pulses for the case shown in FIG. 9.
Figure 11:
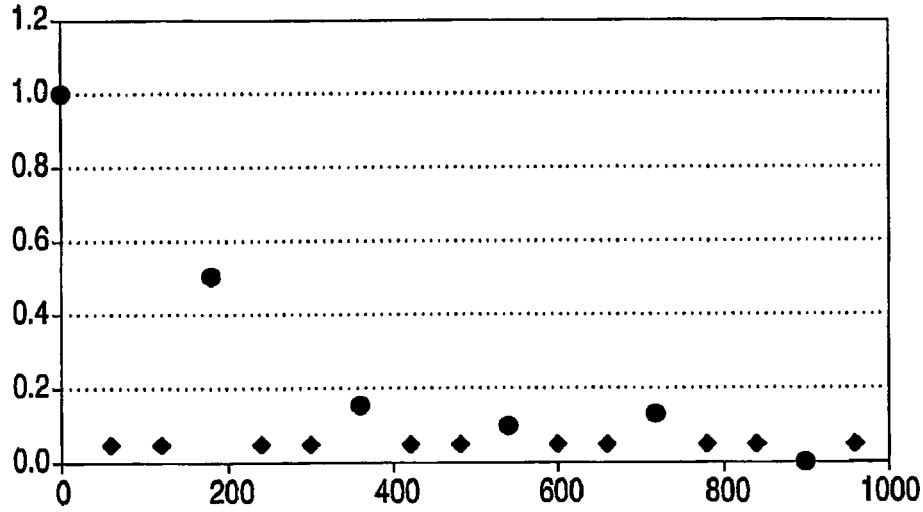
FIG. 11 shows a frequency spectrum of the illumination of a display for the alternating lamp current shown in FIG. 10.

FIG. 11 shows the amplitudes of the various frequency components that occur when a display is illuminated by a lamp having the lamp current shown in FIG. 10. In FIG. 11, circular dots indicate frequency components caused by the modulation of the DC component of the display illumination when the color bars are traversed, and triangular dots indicate the frequency components caused by the first and second pulses. Since the luminous flux cycle in this case covers three subframes, and the subframe frequency is assumed to be 180 Hz, the lowest frequency component of the pulses lies at 60 Hz.

Figure 12:
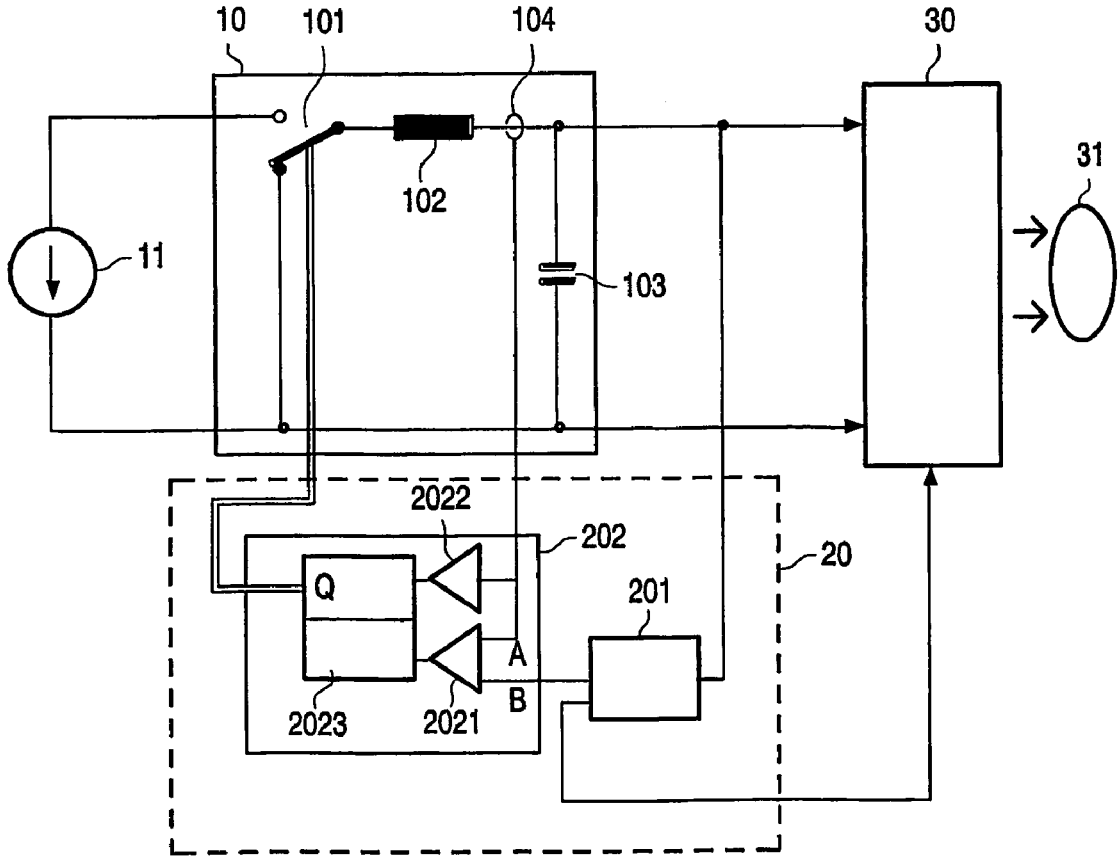
FIG. 12 shows a circuit arrangement for generating an alternating lamp current.

FIG. 12 finally is a block diagram of a circuit arrangement for generating the lamp currents described above. The circuit arrangement essentially comprises a converter 10 known per se (buck converter) for generating a direct current from the supply voltage obtained from a DC voltage source 11, a control device 20 for controlling the converter 10 such that the direct current will have a gradient as described above, and a commutator 30 for converting the direct current of the converter 10 into a suitable alternating lamp current, as well as possibly for generating an ignition voltage for a connected lamp 31.

In detail, the converter 10 comprises a series-connected inductance 102 and at the output thereof a parallel capacitor 103. The inductance 102 is connected to a pole of the DC voltage source 11 in a first switching position of a pole changing switch 101 (usually implemented as a transistor or a diode). In a second switch position, the inductance 102 is connected in parallel to the capacitor 103. A current measuring device 104 is further provided, which generates a current signal which represents the level of the current flowing through the inductance 102.

The control device 20 substantially comprises a microcontroller 201 and a switching unit 202.

A voltage signal obtained from the output of the converter 10 is applied to an input of the microcontroller 201. The microcontroller 201 generates a reference signal (required value for the lamp current) at a first output, which signal is supplied to the switching unit 202, and a current direction signal at a second output, which current direction signal is applied to the commutator 30 and by means of which the commutation of the lamp current is achieved in a synchronized manner.

The switching unit 202 comprises a first logic gate 2021 to whose first input the current signal is applied and to whose second input the reference signal generated by the microcontroller 201 is applied, and a second logic gate 2022, which also receives the current signal. The switching unit 202 further comprises a switching element 2023 with a set input which is connected to the output of the second logic gate 2022, and with a reset input connected to the output of the first logic gate 2021. An output Q of the switching element 2023, finally, is connected to the pole changing switch 101, switching over the latter between its switching positions.

The switching device operates substantially as described below, where it is assumed that the process steps relating to the ignition and run-up of the lamp are known in the art and need not be explained in detail here.

At the start of a switching cycle of the converter 10, the pole changing switch 101 is first in the first (upper) switching position in which it connects the positive pole of the DC voltage source 11 to the inductance 102. The current thus flows through the inductance 102 and increases until its level, detected by means of the current signal, exceeds the reference signal (required value for the current) applied to the second input of the first logic gate 2021. When this is the case, the first logic gate 2021 generates a signal at the reset input of the switching element 2023, so that the latter switches over the pole changing switch 102 into the second (lower) switching position shown in FIG. 12. The inductance 102 is separated from the DC voltage source 11 thereby, and at the same time the capacitor 103 is connected in parallel, so that a decaying current now flows in the circuit thus formed. Once this current has reached zero value, the second logic gate 2022 generates a signal at the set input of the switching element 2023, so that the latter switches over the switch 101 into the first switching position, and the process starts anew.

The switching frequency of the pole changing switch is essentially defined by the dimensioning of the inductance 102 and generally lies between approximately 20 kHz and a few hundreds of kHz. The capacitor 103 is dimensioned such that the output voltage applied to the converter 10 remains substantially constant, so that also the current flowing through the commutator 30 and the lamp 31 remains substantially constant and in the ideal case is half the reference value given by the microcontroller 201. Conversely, the microcontroller 201 must also generate at its first output a current reference signal which is twice as large as the desired lamp current.

The lamp current gradient is determined on the one hand by its frequency and on the other hand by the fact that a first current pulse is to be generated before each polarity change and having the same instantaneous polarity, as was explained above. In dependence on the first current pulses, furthermore, the second current pulses should be generated and should be superimposed on the lamp current in a corresponding manner. The length of the current pulses and the maximum amplitude of the total current flowing through the lamp during a current pulse are essentially defined by the lamp characteristics. All these parameters are stored in the microcontroller 201 (or in a memory), so that the microcontroller can generate the current reference signal with the suitable gradient.

The time schedule for synchronization of the current pulses with the image generation on the display may be variable or constant. The procedure for a constant, predetermined time schedule will be described below.

First the microcontroller 201 calculates the required average current value and the current value during the second pulses in a first sequence of steps from the voltage $U_{meas}$ measured at the output of the converter 10 and supplied as a voltage signal, the second pulses in this example being exactly as long as the first pulses. This first sequence of steps is preferably repeated at regular intervals.

The microcontroller 201 then first detects whether the measured voltage value $U_{meas}$ lies between a minimum and a maximum value. If this is the case, the microcontroller 201 calculates from this voltage value $U_{meas}$ and the lamp power P the required average current value $I_{AGV}=P/U_{meas}$. Then the required current value ($I_{comp}$) for the second pulses is calculated therefrom as well as from the stored amplitude (current value) of the first pulses ($I_{pulse}$) and the stored number $n_{comp}$ of second pulses:

$$I_{comp}=I_{AGV}-\Delta I_{pulse}/n_{comp}, \text{ where } \Delta I_{pulse}=I_{pulse}-I_{AGV}$$

In a second sequence of steps, the reference signal at the first output and furthermore the current direction signal at the second output of the microcontroller 201 is repeatedly generated in accordance with the desired cycle of the alternating lamp current on the basis of these three current values ($I_{AGV}$, $I_{pulse}$and $I_{comp}$) the required switching times being obtained from the memory. It is necessary only to obtain the values of a half cycle each time, because the other half cycle will always have the same gradient (with reversed polarity). In the usual case of a regular distribution in time of the first and second current pulses, furthermore, only two time values are required, i.e. the interval between two current pulses $t_{const}$ and the duration $t_{pulse}$ of the current pulses.

More in detail, the reference signal is first set for double the average current value $I_{AGV}$, so that the lamp current desired for the pulse-free phases is adjusted, as was noted above. After the period $t_{const}$ has elapsed, the reference signal is set for double the current value $I_{comp}$ required for the second current pulse, so that the lamp current will be reduced by the amplitude of the second current pulse. After the pulse time $t_{pulse}$ has elapsed, this procedure is repeated n times in the case in which several (n) second current pulses are to be generated for compensating one of the first current pulses.

If only one second current pulse is to be generated, the reference signal is also set again for double the average current value $I_{AVG}$ in a next step. After the time $t_{const}$ has elapsed, the reference signal is now set for double the current value $I_{pulse}$ required for the next first current pulse, so that the lamp current is increased by the value of the first current pulse. After the pulse duration $t_{pulse}$ has elapsed, finally, the current direction signal is generated at the second output of the microcontroller 201, so that the commutator 30 switches over the current direction of the lamp current and thus initiates the second half cycle of the alternating lamp current in accordance with the first and second sequence of steps described above.

The calculations given above were based on the assumption that the luminous flux supplied by the lamp is substantially linearly dependent on the lamp current. This assumption is justified for most high-pressure gas discharge lamps. In other lamps, the current should be calculated with an additional correction factor for the second current pulses, as applicable, so that the degree to which the luminous flux is increased during one of the first current pulses is again equal to the degree to which the luminous flux is reduced during the associated second current pulse (or the associated total number of second current pulses).

The invention claimed is:

1. A method of operating a high-pressure gas discharge lamp for illuminating a projection display with primary colors that are repeatedly generated sequentially with a cycle duration, wherein the lamp is fed with a lamp current on which are superimposed a series of first current pulses and at least one second current pulse associated with each first current pulse, wherein said first and second current pulses have amplitudes in mutually opposed directions and a definable time difference between them, and wherein the number and/or the level of the amplitude and/or the time length of the second current pulses is/are adjusted such that changes in luminous flux caused by the first current pulse and by the at least one respective associated second current pulse compensate each other at least substantially, wherein the first and second current pulses have a time length from one another which corresponds to one cycle or to a multiple of one cycle of the primary colors.

2. A method as claimed in claim 1, wherein the amplitudes of the first current pulses are directed such that they generate an increase in the generated luminous flux, which increase is at least substantially compensated in that a corresponding reduction of the generated luminous flux is effected by the at least one respective associated second current pulse, and wherein the lamp current is a substantially square-wave alternating current on which the first current pulses are superimposed before a polarity change of the lamp current each time.

3. A method as claimed in claim 1, wherein the first and second current pulses all have substantially the same length in time.

4. A circuit arrangement for operating a high-pressure gas discharge lamp which is provided for illuminating a projection display with primary colors that are repeatedly generated sequentially with a cycle duration, the circuit arrangement comprising a converter for generating a lamp current from a supply voltage, a controller for controlling the converter at an output of the converter, the controller including a microcontroller for generating a series of first current pulses and superimposing them on said lamp current, and for generating at least one second current pulse associated with each first current pulse, wherein said first and second current pulses have amplitudes in mutually opposed directions and a definable time difference between them, and wherein the number and/or the level of the amplitude and/or the time length of the second current pulses is/are adjusted such that changes in luminous flux caused by the first current pulse and by the at least one respective associated second current pulse compensate each other at least substantially, wherein the first and second current pulses generated by microcontroller have a time length from one another which corresponds to one cycle or to a multiple of one cycle of the primary colors.

5. A circuit arrangement as claimed in claim 4, whereby the microcontroller is furthermore for controlling the converter in dependence of a current signal which represents the amplitude of a current flowing through the converter, and furthermore in dependence on a nominal time course of the lamp current stored in the microcontroller.

6. A projection system with a projection display comprising at least one high-pressure gas discharge lamp provided for illuminating a projection display with primary colors that are repeatedly generated sequentially with a cycle duration, and a circuit arrangement for operating the high-pressure gas discharge lamp, wherein the circuit arrangement comprises a converter for generating a lamp current from a supply voltage, a controller for controlling the converter at an output of the converter, the controller including a microcontroller for generating a series of first current pulses and superimposing them on said lamp current, and for generating at least one second current pulse associated with each first current pulse, wherein said first and second current pulses have amplitudes in mutually opposed directions and a definable time difference between them, wherein the number and/or the level of the amplitude and/or the time length of the second current pulses is/are adjusted such that changes in luminous flux caused by the first current pulse and by the at least one respective associated second current pulse compensate each other at least substantially, and wherein the first and second current pulses generated by microcontroller have a time length from one another which corresponds to one cycle or to a multiple of one cycle of the primary colors.

* * * * *